US008845405B2

(12) United States Patent
Greenberg

(10) Patent No.: US 8,845,405 B2
(45) Date of Patent: Sep. 30, 2014

(54) UNIVERSAL BIRD GUARD FOR VENTS

(76) Inventor: Nathan Greenberg, Suffern, NY (US)

( * ) Notice: Subject to any disclaimer, the term of this patent is extended or adjusted under 35 U.S.C. 154(b) by 613 days.

(21) Appl. No.: 12/889,488

(22) Filed: Sep. 24, 2010

(65) Prior Publication Data

US 2011/0076937 A1 Mar. 31, 2011

Related U.S. Application Data

(60) Provisional application No. 61/277,517, filed on Sep. 25, 2009.

(51) Int. Cl.
*F24F 13/20* (2006.01)
*F24F 13/08* (2006.01)

(52) U.S. Cl.
CPC ..... *F24F 13/082* (2013.01)
USPC ..... 454/367

(58) Field of Classification Search
USPC ..... 454/367
See application file for complete search history.

(56) References Cited

U.S. PATENT DOCUMENTS

| | | | | | |
|---|---|---|---|---|---|
| 126,927 | A | * | 5/1872 | Bridgham | 126/536 |
| 809,559 | A | * | 1/1906 | Gault | 220/495 |
| 1,317,674 | A | * | 10/1919 | Alexander | 220/491 |
| 2,601,197 | A | * | 6/1952 | Wilson | 220/485 |
| 3,244,873 | A | * | 4/1966 | Leutheuser | 362/258 |
| 3,847,297 | A | * | 11/1974 | Baader et al. | 454/5 |
| 4,644,456 | A | * | 2/1987 | Lydell | 362/376 |
| 4,773,543 | A | * | 9/1988 | Suttles et al. | 211/59.2 |
| 4,781,147 | A | * | 11/1988 | Delino, Jr. | 119/453 |
| 4,864,477 | A | * | 9/1989 | Engelman | 362/376 |
| 4,887,725 | A | * | 12/1989 | VanNoord | 211/40 |
| 5,102,537 | A | * | 4/1992 | Jones | 210/162 |
| 5,149,039 | A | * | 9/1992 | Peterson et al. | 248/300 |
| 5,335,371 | A | * | 8/1994 | Spessard | 2/9 |
| D357,771 | S | * | 4/1995 | Townsend et al. | D30/199 |
| 5,469,670 | A | * | 11/1995 | Thaler | 52/12 |
| 5,547,422 | A | * | 8/1996 | Seboldt | 454/359 |
| D376,874 | S | * | 12/1996 | Reyes, III | D30/114 |
| 5,616,076 | A | * | 4/1997 | Higgins | 454/367 |
| D390,948 | S | * | 2/1998 | Meyer | D23/393 |
| 5,722,181 | A | * | 3/1998 | Meyer | 34/235 |
| 5,735,091 | A | * | 4/1998 | Hawkins et al. | 52/302.7 |
| 5,765,319 | A | * | 6/1998 | Callaghan, Jr. | 52/101 |
| D397,431 | S | | 8/1998 | Meyer | D23/393 |
| 5,916,023 | A | * | 6/1999 | Meyer | 454/359 |
| 6,155,008 | A | * | 12/2000 | McKee | 52/198 |
| 6,302,788 | B1 | * | 10/2001 | Gagnon | 454/367 |
| 6,361,433 | B1 | * | 3/2002 | Gray | 454/358 |
| 6,520,852 | B2 | * | 2/2003 | McKee et al. | 454/367 |
| 6,598,234 | B1 | * | 7/2003 | Brown et al. | 2/9 |
| 6,631,588 | B1 | * | 10/2003 | Distler | 52/12 |
| 6,640,506 | B2 | * | 11/2003 | Landers | 52/101 |
| 6,775,950 | B2 | * | 8/2004 | Donoho | 52/101 |

(Continued)

*Primary Examiner* — Steven B McAllister
*Assistant Examiner* — Jonathan Cotov
(74) *Attorney, Agent, or Firm* — Ostrolenk Faber LLP

(57) ABSTRACT

An external guard for placement over a vent, having front, lateral and bottom sides each formed by a plurality of generally parallel bars or rods spaced apart to block passage of a bird between bars. The bars are shaped and positioned to define a frusto-pyramidal shape for the guard. The rear side of the guard opens toward the vent. The top side of the guard has a cover. There are no cross bars across the bars along the lateral sides, the side front and the bottom side of the guard and none at the intersection of the front and bottom sides of the guard.

9 Claims, 3 Drawing Sheets

(56) References Cited

U.S. PATENT DOCUMENTS

| | | | | |
|---|---|---|---|---|
| 6,780,100 | B1 * | 8/2004 | Gretz | 454/359 |
| 6,804,911 | B1 * | 10/2004 | Henke | 43/100 |
| 6,918,214 | B2 * | 7/2005 | Sabine | 52/101 |
| 6,990,926 | B2 * | 1/2006 | Gao | 119/461 |
| 7,040,058 | B2 * | 5/2006 | Finkelstein | 52/101 |
| 7,147,554 | B1 * | 12/2006 | Berger | 454/359 |
| 2005/0126506 | A1 * | 6/2005 | Kirch | 119/467 |
| 2011/0312262 | A1 * | 12/2011 | Grandmaison | 454/276 |
| 2011/0312263 | A1 * | 12/2011 | Grandmaison | 454/283 |

* cited by examiner

UNIVERSAL BIRD GUARD FOR VENTS

CROSS REFERENCE TO RELATED APPLICATION

This application claims priority from U.S. Provisional Application 61/277,517 filed Sep. 25, 2009, and incorporated herein by reference.

BACKGROUND OF THE INVENTION

The invention concerns a guard placed over a vent, particularly a vent from a dryer apparatus, such as a clothes dryer, and the guard being particularly intended for guarding against birds passing the guard and entering the vent.

Vents, particularly dryer vents, which open outwardly of a building wall to the environment provide an outlet opening which may be entered by birds and possibly by other animals. To avoid that, various types of guards may be arrayed over the vent preventing access into the vent by birds. Various types of vents, particularly a dryer vent, emit not only air or gas, but also lint or dust which may be generated by the apparatus. Surfaces of the guard will be struck by the emitted lint or dirt. Eventually, that will build up on the elements of the guard over which the vented air or gas passes.

Examples of a bird guard over a vent are illustrated in U.S. Pat. Nos. 5,722,181; 5,916,023, Des. 390,948 and Des. 397, 431. These guards use intersecting bars which create box shaped openings in the sides of the guard. Such openings keep rodents as well as birds from passing the guard. But, these guards have many surfaces of support bars in the vent outflow, which the present invention is intended to minimize.

It is desirable to minimize the extent to which dirt and lint will build up on the guard. Obviously, the fewer elements and the less material of the guard which is in the direct flow out of the vent, the less likely is a build up of lint or dirt or other materials on the guard. A guard consisting of a relatively small cross section, or small diameter bars or widely spaced bars is preferable, because it presents less surface area to the air or gas being vented and is less likely to develop a blocking layer of material emitted from the vent on a use guard. On the other hand, bars too widely separated may not be close enough to neighboring bars to block passage of a bird past the guard and into the vent.

SUMMARY OF THE INVENTION

An object of the invention is to help prevent passage of birds through a guard and into a vent which emits air or gas outward toward the ambient environment.

A further object is to develop the guard with elements with such shape, and size and spacing between adjacent elements as to minimize the chance of eventual blockage of the guard by lint or dirt building up on elements of the guard.

The guard according to the invention is suitable in size to be used universally over standard size vent hoods and particularly over vents to the ambient. As the size of a vent is varied due to the location and air flow required, so may the dimensions of the guard be selected to fit over the vent.

The guard is comprised of respective plurality of bars at each side of the guard. The bars defining each side of the guard are relatively positioned and so oriented that the bars together define an enclosed cage like structure with bars along each of the several sides of the guard structure. The respective plurality of bars on each side of the cage are oriented generally parallel to each other, that is they extend at least approximately only in a single direction. As the guard is usually not of uniform right angled shape from entrance side to the opposite side, the bars of each side are angled to define the changing dimensions of that side. In a preferred embodiment, that single direction of the bars is the vertical direction of the guard on the vertical sides and the horizontal direction of the guard along the generally horizontal side or sides. The spacing between adjacent parallel bars is selected so that it is smaller than the narrow width dimension of the types of bird which are likely to attempt to pass through the guard to the vent which is venting to the ambient environment.

The preferred version of the guard is generally shaped like a cage, in which the vent outlet opens and into which the outlet may extend a short distance. The rear facing side of the guard opens to the vent. The guard has an opposite front facing side, lateral sides extending between the front and the rear sides of the guard, a bottom side and a top side, both extending between the rear and the front sides and between the lateral sides.

Each side of the guard has edge regions where that side is adjacent to a neighboring edge region of an adjacent side of the guard, so that adjacent sides of the guard meet at a respective corner between them.

The width and/or the height dimension of the guard is larger at the rear, vent entrance side of the guard and relatively smaller at the front side of the guard, giving the guard a generally frusto-pyramidal shape, with the wider rear side being open. This additionally allows easy stacking of a supply of the guards, which eases storage and shipping.

The guard preferably has a cover over what is eventually the top side of the guard and cover edge region extend down from the top partially over the lateral sides of the guard. This blocks rain or the like from too easily entering the vent protected by the guard.

The individual bars of which the guard is comprised are preferably round, rather than being flat sided, which minimizes the surface area directly opposing the air or gas flow carrying dirt or lint. This also eases the blowing of lint and dirt off the bars of the guard by the flow of air and particulate material out the vent. Along with the spacing between neighboring bars on each side of the guard being wide enough, this reduces the build up of lint and therefore the blockage of a vent. Thin bars present less surface area for lint. Round ones are preferred over square or flat sided ones. A preferred type of bar for the guard may be a ⅛ inch diameter round shape bar.

On each side of the guard, all the bars extend generally in one direction and are generally parallel. There are no cross bars extending across the bars on any side at locations inward of or between the ends of the bar. This reduces the number of bars, avoids intersections between bars where lint and dirt might be trapped and minimizes the build up of lint and dirt that could block air flow past the bars.

The spacing of the bars that run in the direction from the front to the rear on any of the sides gradually narrows in the direction from the rear toward the front giving the cage a tapering frusto-pyramidal shape. In the preferred cage embodiment, this relates to the bars defining the bottom sides. The bars on the front and lateral sides preferably are vertical. To give the guard its tapering shape, the lateral sides are gradually shorter from the rear to the front of the guard.

The spaced apart bars of the guard make the guard open to cross winds which will assist in blowing lint or dirt off the bars and prevent clogging of the guard. The arrangement of bars is particularly selected for preventing passage of birds and may not be effective to prevent rodents from passing through the guard.

Other objects and features of the present invention will become apparent from the following description of a preferred embodiment considered along with the accompanying drawings.

DETAILED DESCRIPTION OF A PREFERRED EMBODIMENT

Figure 1:
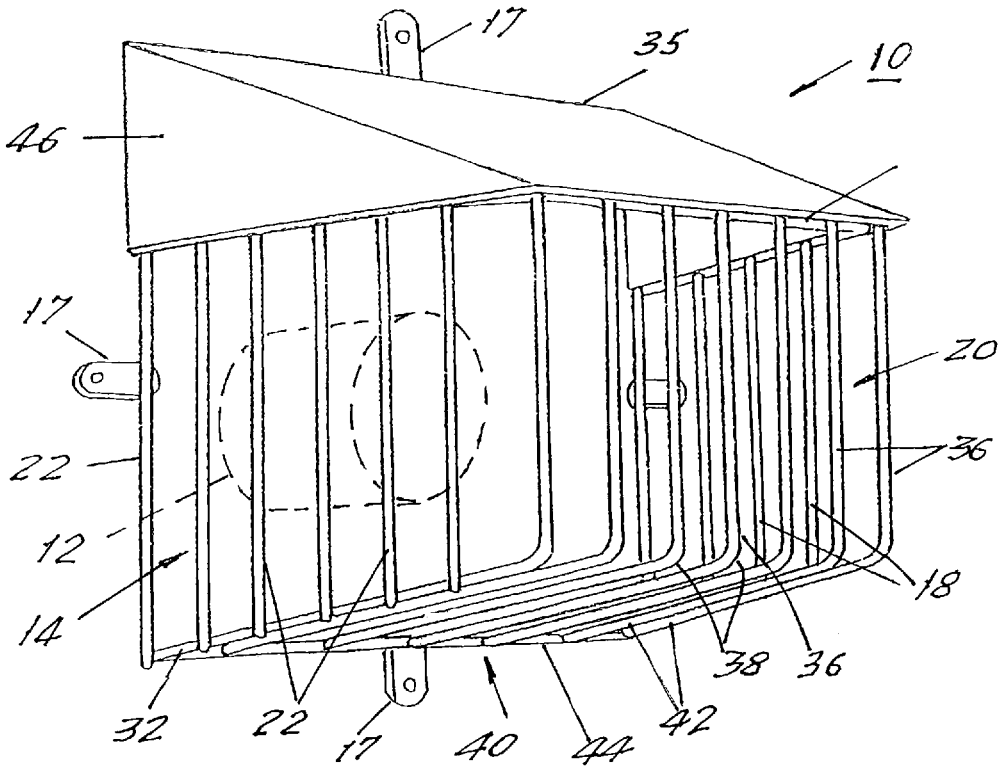
FIG. 1 is a front, side and perspective view of a guard according to the invention.
Figure 2:
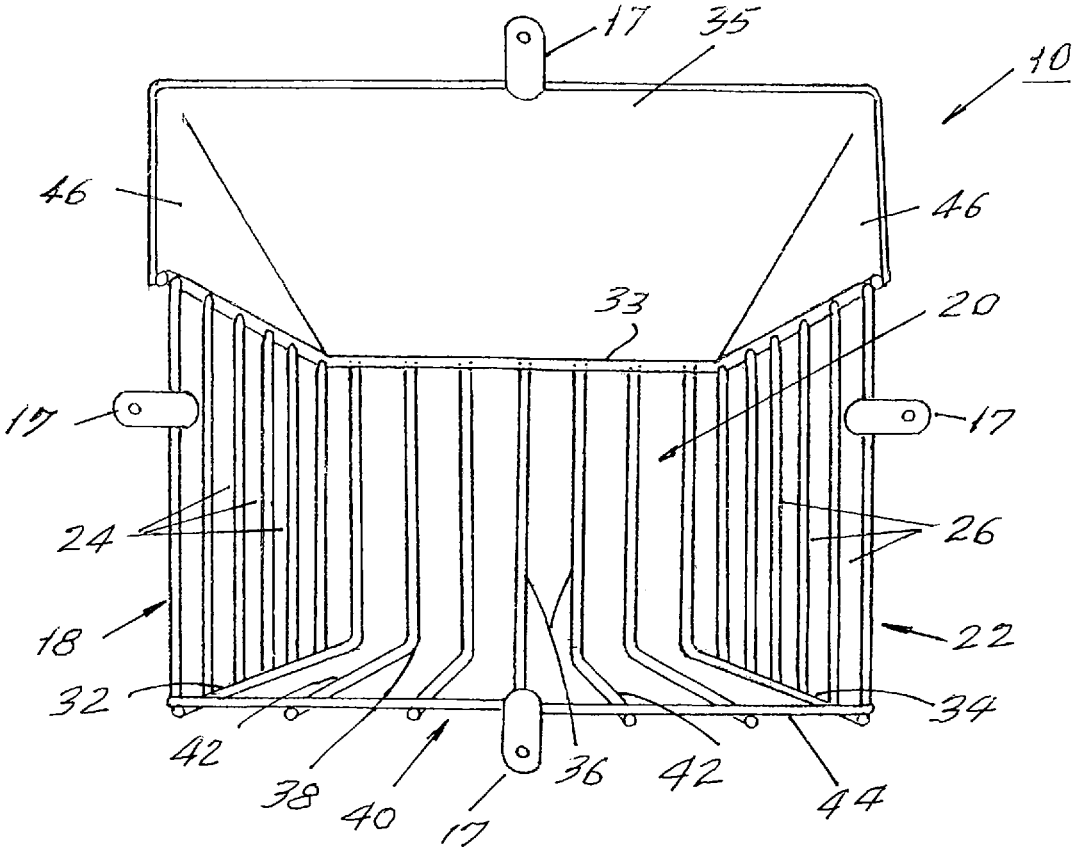
FIG. 2 is a rear view of the guard, at line 2-2 in FIG. 4.
Figure 3:
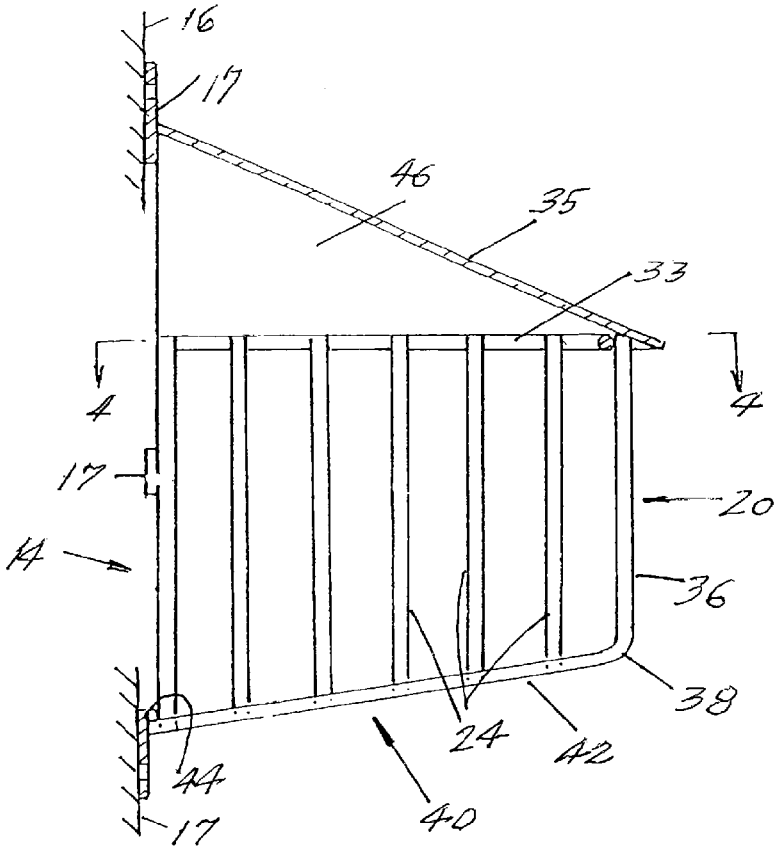
FIG. 3 is one side view of the guard.
Figure 4:
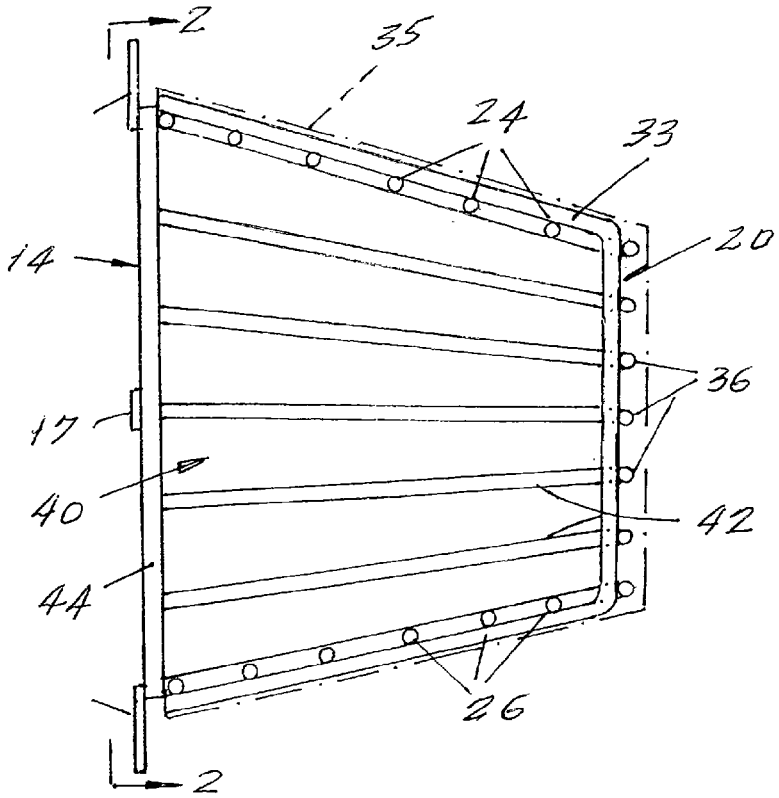
FIG. 4 is a view from below of a cover of the guard, at line 4-4 of FIG. 3.

The present invention concerns a guard 10 for being positioned over a vent 12, typically a vent through a wall or a surface 16. The guard 10 is a separate device which may be attached over a vent or to a wall so that the guard covers the vent. The guard 10 has an open rear side 14 which is the larger upstanding side of the guard. The side 14 is opened to receive the vent 12 passing through the side when the guard is fastened by tabs 17 to a surface 16 around the vent, such as the exterior wall of a building structure through which the vent is outleted.

The guard 10 has a generally frusto-pyramidal shape, tapering sides and bottom and top. As shown, each lateral side 18, 22 of the generally frusto-pyramidal shaped guard is defined by a respective set of vertical bars 24, 26. Each set 24, 26 is attached and extends up from a respective single continuous base bar 32, 34. The vertical bars extend up preferably to a single bar 33 at the top ends thereof and at a cover 35 over the top of the guard. Each of the lateral sides 18, 22 tapers narrower in width from the rear side 14 toward the front side 20 of the guard and with a downward incline of the top cover 35 at the top of the lateral sides and a more gradual upward incline of the bars 32, 34 at the bottom of the lateral sides. The angle of downward incline of the top cover or upward incline of the bottom side bars are a matter of choice.

The front side 20 of the guard 10 is defined by a respective plurality of vertically extending bars 36 extending from a below described junction 38 at the bottom front of the guard up to the cover 35 which projects forward to the front of the guard.

The bottom side 40 of the guard 10 is comprised of a plurality of bars 42 that extend generally horizontally from the rear 14 of the guard toward the front 18 thereof. A support bar 44 for the bottom side bars 42 extends across the bars 42 at the rear of the guard to support and orient the bottom bars. The bar 44 is preferably located out of the exiting air flow.

In the preferred arrangement, each bar 36 defining the front 20 of the guard is preferably attached to or integrated with a respective bottom bar 42 defining the bottom side 40 of the guard. The front bars 36 and bottom 42 bars meet at a bend or junction 38 along the length of the integrated bar dividing each single bar into its guard front and guard bottom sections.

There is a no cross bar at any of the front side, lateral side, bottom or top sides of the guard between the corners defining the ends of each bar on a side of the guard, to minimize the presence of bars in the vented air or gas flow, as lint or dirt may be plated on or adhere to the bars. Further, wherever small bars intersect, regions around their intersections are likely to trap lint and dirt, causing the build up of lint and dirt at sides with cross bars.

An optional but preferable cover 35 is shaped to fit over and is fitted over the top side of the guard. It is shaped to fully cover the top side. Further, the cover itself has short height flaps or sides 46 that extend down and define the upper portion of the lateral sides of the guard and close off access of elements, rain in particular, from entering the guard from the top and upper parts of the lateral sides and therefore from entering a vent which the guard protects.

The openness of the guard structure enables lint and dirt to be blown off the guard bars as air and gas is vented through the vent. Vertical orientation of bars makes it more difficult for lint and dirt to land on and sit on the bars, as it is likely to slip off.

The spacing between neighboring bars of the guard should be selected to be small enough to prevent passage of the types of birds that might enter the vent yet as wide as permissible to minimize the number of bars that will receive lint and dust and to minimize or eliminate the chance of blockage of the guard by lint or dirt. Further, the spacing should allow sufficient air flow from the vent and out the guard.

The material of the guard is a matter of choice. The bars and cover may be of metal, of a plastic material, or of metal covered with an epoxy finish, for example. The material of the guard preferably minimizes sticking of lint and a known non-stick or reduced stick surface is helpful.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A guard for blocking passage through the guard to a vent, the guard comprising:

an enclosure having a plurality of sides, including:

a rear side with an opening to provide access to the vent, the rear side configured for being positioned with the vent at the rear side;

respective opposite lateral sides extending forwardly from the rear side;

a front side extending between the lateral sides and located opposite and spaced away from the rear side;

a bottom side between the lateral sides and between the rear and front sides; and a top side spaced above the bottom side and extending between the lateral sides and between the rear and front sides;

each lateral side and the front side being comprised of a plurality of upstanding bars extending from the bottom side of the enclosure toward the top side of the enclosure, and without any cross bars extending across each respective upstanding bar of the lateral sides and the front side intermediate the bottom side and the top sides of the enclosure, each of the upstanding bars on the lateral sides and the front side being selectively spaced apart from adjacent bars a distance selected for blocking passage of a bird between adjacent bars;

the bottom side comprising a plurality of bottom side bars of bars each extending from the rear side to the front side of the enclosure, the bottom side bars being spaced apart a distance selected so as to prevent passage of a bird between the bottom side bars, the bottom side of the guard not having cross bars extending across the bottom side bars intermediate the front and rear sides of the enclosure wherein the bottom side bars are oriented to extend from the rear side to the front side of the enclosure and are angled to be spaced apart a greater distance toward the rear side of the enclosure and a shorter distance toward the front side of the enclosure.

2. The guard of claim 1, wherein the guard has a generally frusto-pyramidal shape including the rear side forming a wider and taller end of the frusto-pyramidal shape and the front side forming a narrower and shorter end of the frusto-pyramidal shape.

3. The guard of claim 2, further comprising a cover over the top side of the enclosure.

4. The guard of claim 3, wherein the cover includes downwardly depending flaps of a height and width to extend down over a top region of the lateral sides of the enclosure.

5. The guard of claim 1, wherein the bars at the front side of the enclosure each have a bottom end and respective ones of the bottom side bars also have a front end, wherein the bottom ends of the bars on the front side meets of the enclosure the front ends of respective one of the bottom side bars, and there is no cross bar across the bars at the meeting of the bars of the front side and the bottom side bars.

6. The guard of claim 4, wherein the bars at the lateral sides of the enclosure each have a bottom end, and a cross bar extends from the rear side to the front side of the enclosure at the bottom ends of the bars at each lateral side of the enclosure.

7. The guard of claim 1, wherein each of the bars is a round bar.

8. The guard of claim 1, wherein each of the bars has an exterior of a non-stick or reduced stickiness material.

9. A guard for blocking passage through the guard to a vent, the guard comprising:

an enclosure having a plurality of sides, including:

a rear side with an opening to provide access to the vent, the rear side configured for being positioned with the vent at the rear side;

respective opposite lateral sides extending forwardly from the rear side;

a front side extending between the lateral sides and located opposite and spaced away from the rear side;

a bottom side extending between the lateral sides and extending between the rear and front sides; and a top side spaced above the bottom side and extending between the lateral sides and extending between the rear and front sides;

each lateral side and the front side being comprised of a plurality of bars extending across the respective one of the lateral sides and the front side and without any cross bars extending across each respective plurality of the bars on the respective front and lateral sides intermediate ends of the lateral side bars and the front side bars, each of the bars on the lateral sides and the front side being selectively spaced apart from adjacent bars on the respective side of the enclosure a distance selected for blocking passage of a bird between adjacent bars;

the bottom side comprising a plurality of bottom side bars each extending across the bottom side of the enclosure, the bottom side bars being spaced apart a distance selected so as to prevent passage of a bird between the bottom side bars, the bottom side of the enclosure not having cross bars extending across the bottom side bars of the enclosure intermediate the ends of the bottom side bars that extend between two others of the sides of the enclosure wherein the bottom side bars are oriented to extend from the rear side to the front side of the enclosure and are angled to be spaced apart a greater distance toward the rear side of the enclosure and a shorter distance toward the front side of the enclosure.

* * * * *